US007424910B2

(12) United States Patent
Xu et al.

(10) Patent No.: US 7,424,910 B2
(45) **Date of Patent: *Sep. 16, 2008**

(54) DOWNHOLE ABRADING TOOLS HAVING A HYDROSTATIC CHAMBER AND USES THEREFOR

(75) Inventors: Yang Xu, Houston, TX (US); Gerald Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 166 days.

This patent is subject to a terminal disclaimer.

(21) Appl. No.: 11/479,231

(22) Filed: Jun. 30, 2006

(65) Prior Publication Data

US 2008/0000633 A1 Jan. 3, 2008

(51) Int. Cl.
*E21B 47/00* (2006.01)
*E21B 12/02* (2006.01)

(52) U.S. Cl. ..... 166/250.01; 175/39

(58) Field of Classification Search ..... 175/65, 175/39, 48, 42

See application file for complete search history.

(56) References Cited

U.S. PATENT DOCUMENTS 2,457,960 A * 1/1949 Walker ..... 175/39
2,461,164 A * 2/1949 Lewis ..... 175/39
2,468,905 A * 5/1949 Warren, Jr. ..... 175/39
2,560,328 A * 7/1951 Bielstein ..... 175/39
2,582,312 A * 1/1952 Del Homme ..... 175/39
2,657,909 A * 11/1953 Bielstein ..... 175/39
3,011,566 A 12/1961 Graham
3,062,302 A * 11/1962 Toth et al. ..... 175/39
3,155,176 A 11/1964 Bennett
3,578,092 A 5/1971 Tesch et al.

(Continued)

FOREIGN PATENT DOCUMENTS

GB 658323 A 10/1951

(Continued)

OTHER PUBLICATIONS

Notification of Transmittal of the International Search Report and the Written Opinion of the International Searching Authority, Or the Declaration, Nov. 13, 2007, pp. 1-2, PCT/US2007/071926, European Patent Office.

(Continued)

*Primary Examiner*—David J. Bagnell
*Assistant Examiner*—Cathleen R Hutchins
(74) *Attorney, Agent, or Firm*—Greenberg Traurig LLP; Anthony F. Matheny

(57) ABSTRACT

A downhole abrading tool has a body with a first end for connection to a drill string, a cutting end, an exterior surface, a drilling fluid passageway, a valve, and a chamber. Upon exposure of the chamber to a wellbore fluid pressure due to excessive wear on the cutting end, the valve opens. The opening of the valve permits drilling fluid to flow from the drilling fluid passageway, through the exterior surface and into the wellbore. The flow of drilling fluid through the exterior surface causes a pressure drop that is detected at the surface by an operator of the downhole abrading tool. The valve movement may also cause the release of taggants, or indicators, into the drilling fluid that may also be detected by the operator, either visually or with the aid of detection equipment.

20 Claims, 2 Drawing Sheets

U.S. PATENT DOCUMENTS 3,678,883 A 7/1972 Fischer
3,714,822 A 2/1973 Lutz
3,853,184 A * 12/1974 McCullough ..... 175/39
3,865,736 A * 2/1975 Fries ..... 508/539
4,189,012 A 2/1980 Garrett
4,627,276 A 12/1986 Burgess et al.
4,655,300 A * 4/1987 Davis et al. ..... 175/39
4,744,242 A 5/1988 Anderson et al.
4,785,895 A * 11/1988 Davis et al. ..... 175/39
4,818,153 A * 4/1989 Strandell et al. ..... 407/113
4,928,521 A 5/1990 Jardine
5,202,680 A 4/1993 Savage
5,305,836 A 4/1994 Holbrook et al.
5,415,030 A 5/1995 Jogi et al.
5,442,981 A 8/1995 Vegh
5,794,720 A 8/1998 Smith et al.
5,979,571 A 11/1999 Scott et al.
6,109,368 A 8/2000 Goldman et al.
6,131,675 A 10/2000 Anderson
6,233,524 B1 5/2001 Harrell et al.
6,408,953 B1 6/2002 Goldman et al.
6,414,905 B1 7/2002 Owens et al.
6,443,228 B1 9/2002 Aronstam et al.
6,484,824 B2 11/2002 Skyles
6,631,772 B2 10/2003 Palaschenko
6,648,082 B2 11/2003 Schultz et al.
6,693,553 B1 2/2004 Ciglenec et al.
6,725,947 B2 4/2004 Palaschenko et al.
6,867,706 B2 3/2005 Collette
6,915,848 B2 7/2005 Thomeer et al.
6,923,273 B2 8/2005 Terry et al.
6,943,697 B2 9/2005 Ciglenec et al.
6,993,432 B2 1/2006 Jenkins et al.
2004/0190374 A1 9/2004 Alft et al.
2005/0267686 A1 12/2005 Ward
2006/0000604 A1 1/2006 Jenkins et al.
2006/0099885 A1 * 5/2006 Lynde et al. ..... 451/5
2007/0209802 A1 9/2007 Xu et al.

FOREIGN PATENT DOCUMENTS

GB 1276311 A 6/1972
WO WO2005/113926 A 12/2005

OTHER PUBLICATIONS

International Search Report, Nov. 13, 2007, pp. 1-3, PCT/US2007/071926, European Patent Office.
Written Opinion of the International Searching Authority, Nov. 13, 2007, pp. 1-5, PCT/US2007/071926, European Patent Office.
Notification of Transmittal of the International Search Report and the Written Opinion of the International Searching Authority, Or the Declaration, Jan. 8, 2008, pp. 1-2, PCT/US2007/071935, European Patent Office.
International Search Report, Jan. 8, 2008, pp. 1-7, PCT/US2007/071935, European Patent Office.
Written Opinion of the International Searching Authority, Jan. 8, 2008, pp. 1-9, PCT/US2007/071935, European Patent Office.
Office Action dated Feb. 19, 2008 in U.S. Appl. No. 11/479,606.
Office Action dated Feb. 20, 2008 in U.S. Appl. No. 11/496,663.

* cited by examiner

DOWNHOLE ABRADING TOOLS HAVING A HYDROSTATIC CHAMBER AND USES THEREFOR

BACKGROUND

1. Field of Invention

The invention is directed to downhole abrading tools utilized in oil and gas wells to abrade objects within the well and, in particular, to downhole mills that are used to abrade, among other objects, stuck tools, bridge plugs, well tubing, and well casing disposed within the well.

2. Description of Art

In the drilling, completion, and workover of oil and gas wells, it is common to perform work downhole in the wellbore with a tool which has some sort of wearable working profile interfacing with a downhole structure. Examples would be milling a downhole metal object with a milling tool, performing a washover operation with a rotary shoe, cutting through a tubular with a cutting or milling tool, or drilling through formation with a drill bit. During the performance of these operations, it is common for the working profile of the tool, such as the cutting elements mounted on its lower or outer face, to wear away. As this wear progresses, the effectiveness of the tool decreases.

It is desirable to pull the tool from the well and replace it, when the working profile has experienced a given amount of wear. The degree of wear at which it is desirable to replace the tool depends upon the type of tool and the operation being performed. Unfortunately, it is difficult or even impossible for the well operator at the surface of the well to know accurately when this given amount of wear has occurred. Often, the decision as to when to pull the tool depends substantially upon the experience of the operator. That is, the operator must estimate the amount of tool wear based on whatever is known about the time the operation has been underway, the weight on the tool, the type of downhole structure being worked, the cuttings found in the drilling fluid, or a gradual change in work string torque. None of these parameters provides a definitive indication that the wear in the working profile has progressed to a specific degree at which the operator desires to pull the tool from the well. Pulling a tool prematurely adds unnecessary trips out of the well, adding to rig time and increased costs. Pulling the tool too late gradually decreases the effectiveness of the downhole operation, also adding to rig time and increasing the cost of the operation.

Accordingly, downhole abrading tools and methods of indicating to an operator of a downhole abrading tool of excessive wear on a cutting end of the downhole abrading tool have been desired in the art. As discussed herein, the present downhole abrading tools and methods of indicating to an operator of a downhole abrading tool of excessive wear on the cutting end of a downhole abrading tool effectively and efficiently identify excessive wear on the downhole abrading tool. Therefore, the operator of the downhole abrading tool is informed of when the downhole abrading tool should be removed from the well and replaced.

SUMMARY OF INVENTION

Broadly, the invention is directed to downhole abrading tools utilized in cutting or abrading objects disposed within the well. The term "object" encompasses any physical structure that may be disposed within a well, for example, another tool that is stuck within the well, a bridge plug, the well tubing, or the well casing.

The downhole abrading tools of the invention include a chamber having a valve disposed therein. As the downhole abrading tool abrades the object in the well, the cutting end is worn away. A fluid flow path is formed between the wellbore and the chamber due to excessive wear on the cutting end of the tool. The wellbore fluid pressure causes the valve to move, and movement of the valve causes a pressure change in the drilling fluid pressure.

In the preferred embodiment, movement of the valve permits drilling fluid to flow through one or more bypass ports in the body of the downhole abrading tool. The bypass ports are disposed along the exterior surface of the downhole abrading tool. Drilling fluid is initially prevented from flowing through the bypass ports by the valve. Upon the cutting end undergoing excessive wear, a fluid flow path is formed between the wellbore and the chamber. The valve is opened and drilling fluid is permitted to flow from the drilling fluid passageway and through the bypass ports into the wellbore. Due to the increase in volume of drilling fluid from the downhole abrading tool, the pressure of the drilling fluid, being monitored by the operator at the surface, will noticeably drop to indicate that the tool has experienced excessive wear.

In accordance with the invention, the foregoing advantages have been achieved through the present downhole abrading tool for rotatably abrading an object in a well. The downhole abrading tool comprises a body for connection to a drill string and having a drilling fluid passageway therethrough with an outlet for the passage of a drilling fluid having a drilling fluid pressure; a cutting end on the body for rotation against an object in the well; a chamber having a wear-away portion that is recessed within the cutting end, the wear-away portion wearing away and exposing the chamber to wellbore pressure when the cutting end wears a selected amount; and a valve in fluid communication with the chamber and the drilling fluid passageway, for creating a pressure change in the drilling fluid passageway when the chamber is exposed to the wellbore pressure.

A further feature of the downhole abrading tool is that the pressure change may comprise a drop in drilling fluid pressure. Another feature of the downhole abrading tool is that the valve may include a piston slidably carried within a portion of the chamber, the piston moving the valve from a first position to a second position when the chamber is exposed to wellbore pressure. An additional feature of the downhole abrading tool is that the piston may be pressure-balanced so as to be unaffected by wellbore pressure until the wear-away portion of the chamber is exposed to wellbore pressure. Still another feature of the downhole abrading tool is that the valve may comprise a sleeve that moves axially from a lower position to an upper position when the wear-away portion of the chamber is exposed to wellbore pressure, the valve having an inner side exposed to drilling fluid pressure in the drilling fluid passageway and an outer side exposed to wellbore pressure. A further feature of the downhole abrading tool is that the downhole abrading tool may further comprise an upper piston on the sleeve slidably carried within a sealed cavity of the body; a lower piston on the sleeve slidably carried within a portion of the chamber; and wherein the valves and the pistons move upward in unison in response to wellbore pressure being applied from the wear-away portion of the chamber to the lower piston, creating a bypass port from the drilling fluid passageway to the wellbore. Another feature of the downhole abrading tool is that the pressure areas of the upper and lower pistons may equal each other.

An additional feature of the downhole abrading tool is that the downhole abrading tool may further comprise at least one taggant carried by taggant and contained within the body by the valve; and wherein movement of the valve permits the at least one taggant to move from the body and return to an upper end of the well along with the drilling fluid. Still another feature of the downhole abrading tool is that the taggant may be selected from the group consisting of a radio-frequency tag, a colored dye, a radioactive material, a florescent material, a pellet, each of the at least one pellets having an outer shell encasing a core, the outer shell being dissolvable in the drilling fluid and the core being an expandable material, and mixtures thereof. A further feature of the downhole abrading tool is that the downhole abrading tool may further comprise a bypass port leading from the drilling fluid passageway to an exterior portion of the downhole abrading tool, the bypass port being closed by the valve until the wear-away portion of the chamber is exposed to the wellbore pressure.'

In accordance with the invention, the foregoing advantages also have been achieved through a downhole abrading tool for rotatably abrading an object in a well, the well having a surface location and a downhole location. The downhole abrading tool comprises a body having a first end, a cutting end, and a drilling fluid passageway extending through the body and having an outlet for discharging a drilling fluid having a drilling fluid pressure, the first end adapted for being connected to a portion of a string for rotation, and the cutting end containing an abrasive material for rotatably engaging the object in the well; a bypass port extending from the fluid passageway to an exterior portion of the body; a valve that initially closes the bypass port, the valve having a piston portion that moves the valve to an open position in response to a pressure differential; and a chamber within the body in fluid communication with the piston portion, the chamber having an indicator portion adjacent the cutting end such that, when the chamber becomes in fluid communication with a wellbore fluid pressure due to wear of the abrasive material into the indicator portion, the wellbore fluid pressure causes the piston to move the valve to the open position, such that the drilling fluid is permitted to flow from the fluid passageway and through the bypass port and the outlet, providing a pressure drop indication at the surface location.

A further feature of the downhole abrading tool is that the downhole abrading tool may further comprise at least one taggant held within the body by the valve, wherein movement of the valve to the open position permits taggant to flow from the body to the surface location with the drilling fluid. Another feature of the downhole abrading tool is that the piston portion may be pressure balanced so as to remain stationary until the valve opens, regardless of changes in wellbore fluid pressure. An additional feature of the downhole abrading tool is that the downhole abrading tool may further comprise a pressure balance piston on the valve that is slidably carried within a cavity for balancing any forces applied to the piston portion by the drilling fluid pressure and the wellbore fluid pressure while the valve is closed. Still another feature of the downhole abrading tool is that the valve may comprise an annular sleeve having an inner side for exposure to the drilling fluid pressure in the drilling fluid passageway and an outer side for exposure to wellbore fluid pressure. A further feature of the downhole abrading tool is that the sleeve may move axially when moving to the open position.

In accordance with the invention, the foregoing advantages also have been achieved through the present method of indicating wear of a downhole abrading tool having a body for connection to a drill string and having a drilling fluid passageway therethrough having an outlet for the passage of a drilling fluid having a drilling fluid pressure, and a cutting end on the body for rotation against an object in the well. The method comprises the steps of: (a) providing a chamber with a wear-away portion that is recessed within the cutting end; (b) providing a valve in fluid communication with the chamber and the drilling fluid passageway; (c) during operation, causing the wear-away portion to wear away and expose the chamber to a wellbore having a wellbore fluid pressure; then (d) causing the valve to move in response to the wellbore fluid pressure; and (e) the movement of the valve causes a change in the drilling fluid pressure.

A further feature of the method of indicating wear of a downhole abrading tool is that step (e) may comprise reducing the drilling fluid pressure. Other features of the method of indicating wear of a downhole abrading tool is that step (b) may comprise providing a bypass port from the drilling fluid passageway to an exterior portion of the body and closing the bypass port with the valve; and step (e) may comprise opening the bypass port with the valve, permitting drilling fluid to flow out the bypass port and the outlet. An additional feature of the method of indicating wear of a downhole abrading tool is that step (e) may further comprise causing the valve to release at least one taggant disposed within the body for transporting the at least one taggant with the drilling fluid to an upper end of the well.

The downhole abrading tools and methods of indicating to an operator of a downhole abrading tool of excessive wear on a cutting end of the downhole abrading tool have the advantages of providing effective and efficient identification of excessive wear on the downhole abrading tool.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
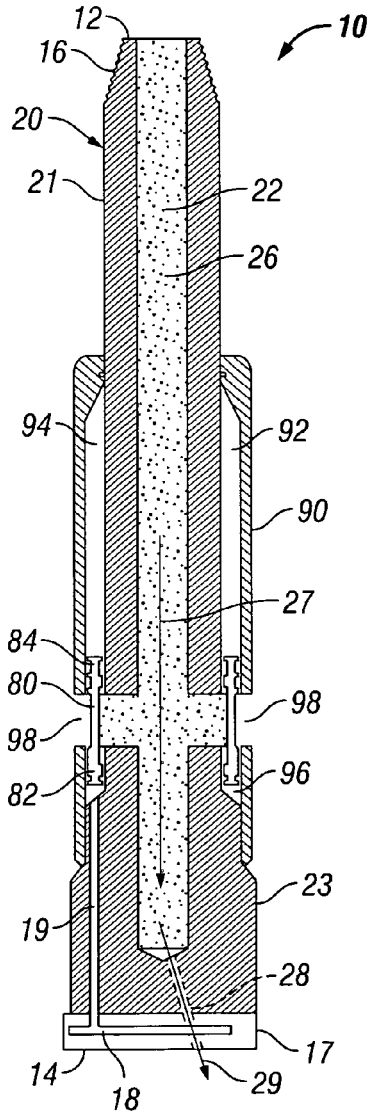
FIG. 1 is a cross-sectional view of a specific embodiment of a downhole abrading tool of the present invention during operation prior to excessive wear.
Figure 2:
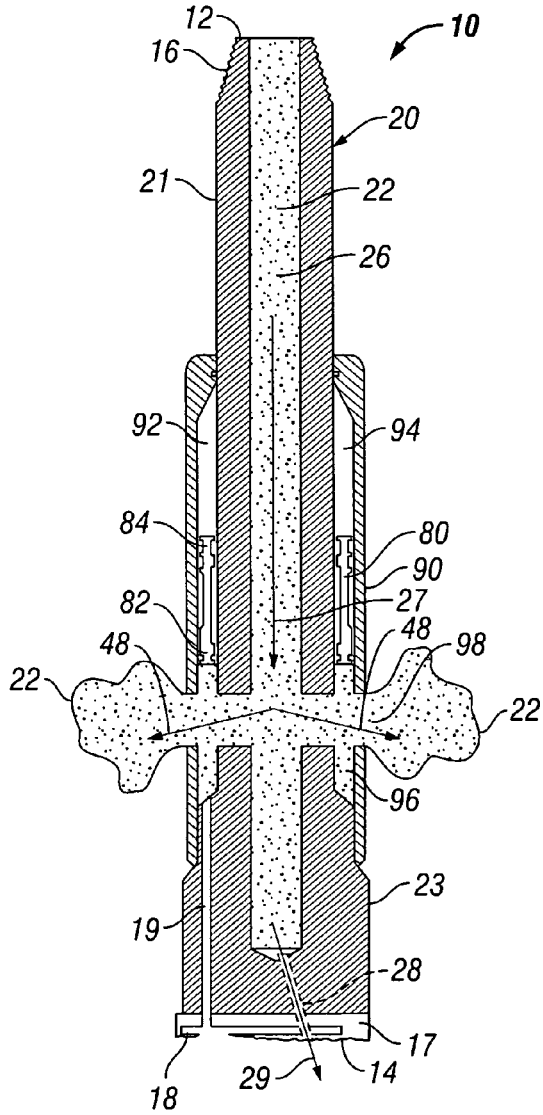
FIG. 2 is a cross-sectional view of the embodiment of the downhole abrading tool shown in FIG. 1 in which excessive wear has caused drilling fluid to flow through the ports into the well environment.
Figure 3:
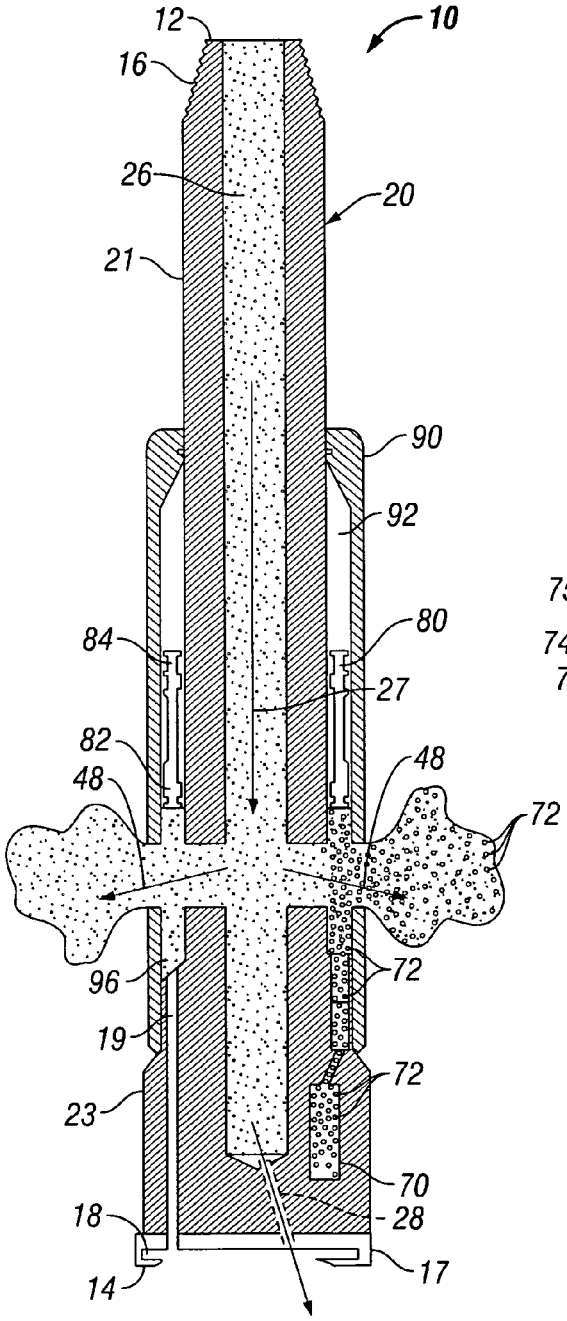
FIG. 3 is a cross-sectional view of another specific embodiment of a downhole abrading tool of the present invention.

Referring to FIGS. 1-3, downhole abrading tool 10 has first end 12 and cutting end 14. First end 12 is adapted to be connected to a string (not shown) to facilitate rotation of downhole abrading tool 10. As shown in FIGS. 1-3, first end 12 includes threads 16 to facilitate attachment to the string.

Downhole abrading tool 10 includes body 20 having exterior surface 21. Body 20 includes drilling fluid passageway 26 disposed longitudinally within body 20 and head 23. Drilling fluid 22 flows from the surface at a drilling fluid pressure, through drilling fluid passageway 26 (as indicated by arrow 27) and through drilling fluid outlets or nozzles 28 (shown in dashed lines) into the well environment (as indicated by arrow 29). Drilling fluid 22 facilitates cutting by downhole abrading tool 10. Drilling fluid 22 is the circulated up the wellbore and returned to the surface.

Cutting end 14 includes abrading matrix 17 formed of an abrading material, such as hardfacing or other cutting or abrading material known in the art. Disposed within abrading matrix 17 is wear-away chamber 18, which is in fluid communication with passage 19 extending upward within body 20. Wear-away chamber 18 is a sealed chamber located within cutting end 14. Wear-away chamber 18 is isolated from the pressure of the drilling fluid while still within drilling fluid passageway 26, and is also isolated from the wellbore fluid pressure. The wellbore fluid pressure comprises the discharge pressure at outlet 28 and the hydrostatic fluid pressure in the wellbore.

Downhole abrading tool 10 also includes sleeve 90 disposed along exterior surface 21 of downhole abrading tool 10. Sleeve 90 includes cavity 92 having upper cavity portion 94 and lower cavity portion 96. One or more bypass ports 98 are in fluid communication with hydrostatic cavity 92. Bypass ports 98 extend from drilling fluid passageway 26 through cavity 92 and sleeve 90 to the wellbore. Passage 19 leads to cavity lower portion 96.

Disposed within hydrostatic cavity 92 is valve 80 having a closed position and a plurality of opened positions. When closed, valve 80 blocks the flow of drilling fluid 22 from drilling fluid passageway 26 through bypass port 98 to the wellbore. Valve 80 is preferably a sleeve.

In the embodiment shown in FIGS. 1-3, valve 80 has a lower annular piston portion 82 which is capable of sliding along exterior surface 21 within lower cavity portion 96. Valve 80 also has an upper annular piston portion 84 that slides sealingly within upper cavity portion 94. Valve piston portions 82, 84 move in union with valve 80. The drilling fluid pressure in drilling fluid passageway 26 exerts a downward force on lower piston portion 82 and an upward force on upper piston portion 84. Similarly, wellbore fluid pressure causes a downward force on lower piston portion 82 and an upward force on upper piston portion 84. Also, pressure, if any, in wear-away chamber 18 and passage 19 would exert an upward force on lower piston portion 82. Any pressure in upper cavity portion 94 would exert a downward force on upper piston portion 84. Piston portions 82, 84 are pressure balanced so that valve 80 does not move axially regardless of changes in pressure in drilling fluid passageway 26 and in the wellbore. Preferably, piston portions 82, 84 have the same inner and outer diameters and preferably upper and lower cavity portions 94, 96 initially are at atmospheric pressure.

When cutting end 14 experiences excessive wear (FIG. 2), wear-away chamber 18 is exposed to wellbore fluid pressure. As a result, passage 19 and, thus, lower cavity portion 94 are also exposed to the wellbore pressure. Accordingly, the wellbore pressure acts on the pressure area of lower piston portion 82. Because the pressure in upper cavity portion 94 is at atmospheric, the pressure difference causes valve 80 to move upward into upper cavity portion 94. Therefore, a drilling fluid flow path from drilling fluid passageway 26, through bypass port 98 into the well environment is formed so that drilling fluid 22 is permitted to flow in the direction of arrows 48. Flow also continues through nozzle 28. Accordingly, the pressure of drilling fluid 22, being monitored by the operator at the surface, will noticeably drop to indicate to the operator that downhole abrading tool 10 has experienced excessive wear and should be replaced.

In another embodiment shown in FIG. 3, downhole abrading tool 10 is designed and operates in the same manner discussed above with respect to the embodiment shown in FIGS. 1-2. The embodiment shown in FIG. 3, however, includes taggant chamber 70 in fluid communication with lower cavity portion 96. Taggant chamber 70 includes one or more taggants 72. Each taggant 72 may be, for example, a colored dye, a radio-frequency tag, a radioactive material, a florescent material, or a pellet having an outer shell that is dissolvable in the drilling fluid encasing a core formed of an expandable material such as styrofoam.

Lower piston portion 82 initially blocks taggant chamber 70 so that no taggants 72 are permitted to flow from taggant chamber 70 into drilling fluid 22. Upon hydrostatic flow path 18 being exposed to well environment due to excessive wear on cutting end 14 as discussed in greater detail above, lower piston portion 82 moves upwards within hydrostatic cavity 92 as also discussed in greater detail above. As a result, piston 80 is no longer blocking taggant chamber 70 and, thus, taggants 72 are released into drilling fluid 22.

As the drilling fluid circulates up the well to the surface of the well, it carries with it each of the released taggants 72. Upon reaching the surface of the well, taggants 72 are detected by the operator of the downhole abrading tool 10, either visually, or using equipment designed specifically for the detection of taggant 72. Identification of taggants 72 by the operator provides another indication that downhole abrading tool 10 has experienced excessive wear. Subsequent to the operator detecting the released taggants 72, the operator will remove downhole abrading tool 10 from the well to replace downhole abrading tool 10.

Figure 4:
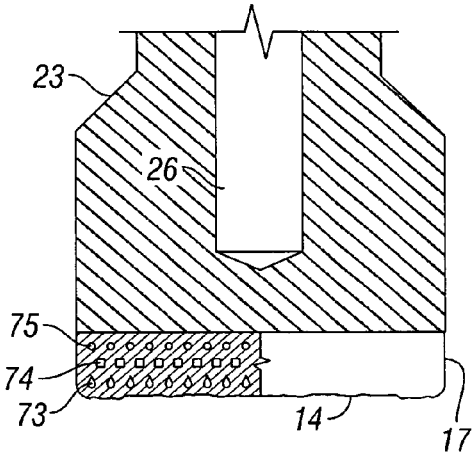
FIG. 4 is a partial cross-sectional view of an additional specific embodiment of a downhole abrading tool of the present invention.

In another specific embodiment shown in FIG. 4, downhole abrading tool 10 also includes taggants 72 embedded or disposed within abrading matrix 17. As shown in FIG. 4, different taggants 72 are disposed at different locations within abrading matrix 17, thereby providing different indications as to the extent of wear on cutting end 14. For example, taggants 73 are released prior to taggants 74, and taggants 74 are released prior to taggants 75. Accordingly, an operator is provided with incremental indication as to the wear on cutting end 14. Alternatively, taggants 73, 74, and 75 can be disposed in specific areas of abrading matrix 17, e.g., taggants 73 on the sides, taggants 74 on the bottom, and taggants 75 in the middle so that an indication can be made as to the specific area or region of cutting end 14 undergoing wear.

Various combinations of the different types of taggants 72 can be used to better educate the operator as to the location of the excessive wear on cutting end 14 as well as the degree of wear occurring at various locations of cutting end 14. For example, taggants 72 having colored dyes may be released if excessive wear occurs on the outer portions of abrading matrix 17 and taggants 72 having radio-frequency tags may be released if excessive wear occurs on the center portion of abrading matrix 17.

Additionally, taggants 72 can be formed integral with the abrading material that forms abrading matrix 17. In other words, in this embodiment, taggants 72 are embedded or disposed within abrading matrix 17 during the formation of abrading matrix 17.

It is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims. For example, the valve could be configured to block or restrict drilling fluid flow when moved from its initial position. If so, a pressure increase or spike would be observed, rather than a decrease.

What is claimed is:

1. A downhole abrading tool for rotatably abrading an object in a well, the downhole abrading tool comprising:

a body for connection to a drill string and having a drilling fluid passageway therethrough with an outlet for the passage of a drilling fluid having a drilling fluid pressure;

a cutting end on the body for rotation against an object in the well;

a chamber having a wear-away portion that is recessed within the cutting end, the wear-away portion wearing away and exposing the chamber to wellbore pressure when the cutting end wears a selected amount; and a valve in fluid communication with the chamber and the drilling fluid passageway, for creating a pressure change in the drilling fluid passageway when the chamber is exposed to the wellbore pressure.

2. The downhole abrading tool of claim 1, wherein the pressure change comprises a drop in drilling fluid pressure.

3. The downhole abrading tool of claim 1, wherein the valve includes a piston slidably carried within a portion of the chamber, the piston moving the valve from a first position to a second position when the chamber is exposed to wellbore pressure.

4. The downhole abrading tool of claim 3, wherein the piston is pressure-balanced so as to be unaffected by wellbore pressure until the wear-away portion of the chamber is exposed to wellbore pressure.

5. The downhole abrading tool of claim 1, wherein the valve comprises a sleeve that moves axially from a lower position to an upper position when the wear-away portion of the chamber is exposed to wellbore pressure, the valve having an inner side exposed to drilling fluid pressure in the drilling fluid passageway and an outer side exposed to wellbore pressure.

6. The downhole abrading tool of claim 5, wherein the downhole abrading tool further comprises:

an upper piston on the sleeve slidably carried within a sealed cavity of the body;

a lower piston on the sleeve slidably carried within a portion of the chamber; and wherein the valves and the pistons move upward in unison in response to wellbore pressure being applied from the wear-away portion of the chamber to the lower piston, creating a bypass port from the drilling fluid passageway to the wellbore.

7. The downhole abrading tool of claim 6, wherein the pressure areas of the upper and lower pistons equal each other.

8. The downhole abrading tool of claim 1, wherein the downhole abrading tool further comprises at least one taggant carried by and contained within the body by the valve; and wherein movement of the valve permits the at least one taggant to move from the body and return to an upper end of the well along with the drilling fluid.

9. The downhole abrading tool of claim 8, wherein the taggant is selected from the group consisting of a radio-frequency tag, a colored dye, a radioactive material, a florescent material, a pellet, each of the at least one pellets having an outer shell encasing a core, the outer shell being dissolvable in the drilling fluid and the core being an expandable material, and mixtures thereof.

10. The downhole abrading tool of claim 1, wherein the downhole abrading tool further comprises:

a bypass port leading from the drilling fluid passageway to an exterior portion of the downhole abrading tool, the bypass port being closed by the valve until the wear-away portion of the chamber is exposed to the wellbore pressure.

11. A downhole abrading tool for rotatably abrading an object in a well, the well having a surface location and a downhole location, the downhole abrading tool comprising:

a body having a first end, a cutting end, and a drilling fluid passageway extending through the body and having an outlet for discharging a drilling fluid having a drilling fluid pressure, the first end adapted for being connected to a portion of a string for rotation, and the cutting end containing an abrasive material for rotatably engaging the object in the well;

a bypass port extending from the fluid passageway to an exterior portion of the body;

a valve that initially closes the bypass port, the valve having a piston portion that moves the valve to an open position in response to a pressure differential; and a chamber within the body in fluid communication with the piston portion, the chamber having an indicator portion adjacent the cutting end such that, when the chamber becomes in fluid communication with a wellbore fluid pressure due to wear of the abrasive material into the indicator portion, the wellbore fluid pressure causes the piston to move the valve to the open position, such that the drilling fluid is permitted to flow from the fluid passageway and through the bypass port and the outlet, providing a pressure drop indication at the surface location.

12. The downhole abrading tool of claim 11, wherein the downhole abrading tool further comprises at least one taggant held within the body by the valve, and wherein movement of the valve to the open position permits taggant to flow from the body to the surface location with the drilling fluid.

13. The downhole abrading tool of claim 11, wherein the piston portion is pressure balanced so as to remain stationary until the valve opens, regardless of changes in wellbore fluid pressure.

14. The downhole abrading tool of claim 11, wherein the downhole abrading tool further comprises a pressure balance piston on the valve that is slidably carried within a cavity for balancing any forces applied to the piston portion by the drilling fluid pressure and the wellbore fluid pressure while the valve is closed.

15. The downhole abrading tool of claim 13, wherein the valve comprises an annular sleeve having an inner side for exposure to the drilling fluid pressure in the drilling fluid passageway and an outer side for exposure to wellbore fluid pressure.

16. The downhole abrading tool of claim 15, wherein the sleeve moves axially when moving to the open position.

17. A method of indicating wear of a downhole abrading tool having a body for connection to a drill string and having a drilling fluid passageway therethrough having an outlet for the passage of a drilling fluid having a drilling fluid pressure, and a cutting end on the body for rotation against an object in the well, the method comprising the steps of:

(a) providing a chamber with a wear-away portion that is recessed within the cutting end;

(b) providing a valve in fluid communication with the chamber and the drilling fluid passageway;

(c) during operation, causing the wear-away portion to wear away and expose the chamber to a wellbore having a wellbore fluid pressure; then (d) causing the valve to move in response to the wellbore fluid pressure; and (e) the movement of the valve causes a change in the drilling fluid pressure.

18. The method of claim 17, wherein step (e) comprises reducing the drilling fluid pressure.

19. The method of claim 17, wherein step (b) comprises providing a bypass port from the drilling fluid passageway to an exterior portion of the body and closing the bypass port with the valve; and step (e) comprises opening the bypass port with the valve, permitting drilling fluid to flow out the bypass port and the outlet.

20. The method of claim 17, wherein step (e) of the method further comprises causing the valve to release at least one taggant disposed within the body for transporting the at least one taggant with the drilling fluid to an upper end of the well.

* * * * *